US011920313B2

(12) United States Patent
Li et al.

(10) Patent No.: US 11,920,313 B2
(45) Date of Patent: Mar. 5, 2024

(54) AQUEDUCT LEAKAGE REPAIRING METHOD

(71) Applicant: GUANGDONG RESEARCH INSTITUTE OF WATER RESOURCES AND HYDROPOWER, Guangzhou (CN)

(72) Inventors: Zhaoheng Li, Guangzhou (CN); Liang Xie, Guangzhou (CN); Jinlin Huang, Guangzhou (CN); Lihua Wang, Guangzhou (CN); Junlu Zhang, Guangzhou (CN)

(73) Assignee: GUANGDONG RESEARCH INSTITUTE OF WATER RESOURCES AND HYDROPOWER, Guangzhou (CN)

( * ) Notice: Subject to any disclaimer, the term of this patent is extended or adjusted under 35 U.S.C. 154(b) by 673 days.

(21) Appl. No.: 16/973,803

(22) PCT Filed: Sep. 24, 2019

(86) PCT No.: PCT/CN2019/107483

§ 371 (c)(1),
(2) Date: Dec. 10, 2020

(87) PCT Pub. No.: WO2020/168711

PCT Pub. Date: Aug. 27, 2020

(65) Prior Publication Data

US 2021/0131052 A1 May 6, 2021

(30) Foreign Application Priority Data

Feb. 21, 2019 (CN) ..... 201910128251.0

(51) Int. Cl.
*E02B 5/02* (2006.01)
*E02B 3/16* (2006.01)

(52) U.S. Cl.
CPC . *E02B 5/02* (2013.01); *E02B 3/16* (2013.01)

(58) Field of Classification Search
CPC ..... E02B 5/02; E02B 7/54; E02B 3/16; E04G 23/02; E04G 23/0229
See application file for complete search history.

(56) References Cited

U.S. PATENT DOCUMENTS 1,646,997 A * 10/1927 Gelder ..... E02B 3/16 404/27
1,691,402 A * 11/1928 Oden ..... E02B 3/16 52/396.04

(Continued)

FOREIGN PATENT DOCUMENTS

CN 102797218 A 11/2012
CN 104179349 A 12/2014

(Continued)

OTHER PUBLICATIONS

International Search Report of PCT Patent Application No. PCT/CN2019/107483 dated Dec. 4, 2019.

*Primary Examiner* — Gisele D Ford

(57) ABSTRACT

The present invention relates to an aqueduct leakage repairing method, a formwork is provided within an aqueduct body; a reinforcing layer is formed by using the formwork through casting at inner sides of the aqueduct body; the formwork comprises side formwork plates, bottom formwork plates, and axillary angle formwork plates; the side formwork plates are arranged at inner vertical walls of the aqueduct body, the bottom formwork plates are arranged on a bottom of the aqueduct body, the bottom formwork plates are connected with the side formwork plates through the axillary angle formwork plates; and the axillary angle formwork plates are each provided with a plurality of ribs. The aqueduct leakage repairing method effectively reinforces penetration damage of the aqueduct, and the construction (Continued)

process is simple since the formwork is free from dismantling after construction.

7 Claims, 6 Drawing Sheets

(56) References Cited

U.S. PATENT DOCUMENTS 1,740,110 A * 12/1929 Oden ..... E02B 3/16 52/417
3,326,005 A * 6/1967 Jacobs ..... E02B 5/02 405/17
3,744,255 A * 7/1973 Jacobs ..... E02B 3/128 405/84
4,476,074 A * 10/1984 Bindhoff ..... E04G 9/065 249/19
4,659,252 A * 4/1987 Sexton ..... E02B 7/02 405/116
4,832,528 A * 5/1989 Lisart ..... E02B 3/16 405/116
5,720,576 A * 2/1998 Scuero ..... E02B 3/16 405/116
7,614,826 B2 * 11/2009 Vriens ..... E02B 3/102 405/107
9,758,968 B2 * 9/2017 Leinenbach ..... C22C 38/14
10,422,096 B2 * 9/2019 Scuero ..... E02B 5/02
2015/0167332 A1 * 6/2015 Shiota ..... E04G 23/0218 52/514
2016/0010297 A1 * 1/2016 Tavella ..... E02B 3/066 405/287
2021/0131052 A1 * 5/2021 Li ..... E02B 3/16

FOREIGN PATENT DOCUMENTS

CN 105178256 A 12/2015
CN 105625265 A 6/2016

* cited by examiner

AQUEDUCT LEAKAGE REPAIRING METHOD

TECHNICAL FIELD

The present invention relates to an aqueduct leakage repairing method which belongs to the field of hydraulic engineering, in particular to the field of repairing aqueducts in hydraulic engineering.

BACKGROUND

Aqueducts are a kind of overhead water conveyance structure which conveys canal water across rivers, roads, mountains, valleys, etc., and are one of the most widely used three-dimensional crossing structures in hydraulic structures. In addition to conveying canal water, they can also be used for flood discharge, sediment discharge, navigation and diversion. With the construction of the South-to-North Water Diversion Project and the domestic water conservancy infrastructure, aqueducts have been widely adopted. Large aqueducts often adopt new prestressed technology, and relevant research results have appeared one after another. Aqueducts are a kind of important hydraulic structure in long-distance water transfer project. Once they fails, direct and indirect economic losses will be immeasurable.

The main causes of aqueduct damage include earthquake, wind, water damage, durability problems (including concrete carbonization, water stop aging, freeze-thaw, corrosion, water erosion, soil frost heave, uneven settlement, etc.), overload damage and unreasonable design or poor construction quality, and so on, among which earthquake, wind, and water damage are sudden. A damaged aqueduct is commonly embodied by leakage of aqueduct body and unstable structure of aqueduct body. The leakage of aqueduct body will cause corrosion of steel bars. When the corrosion of the steel bars reaches a certain level, the volume of the steel bars expands. The concrete outside the aqueduct cracks under the action of expansion force, until it collapses, which damages aqueduct wall structure and affects normal use of the aqueduct.

In order to prevent aqueducts from leaking, commonly used reinforcement methods mainly use special concrete, mesh cloth and fiber materials for reinforcement. However, the existing methods have many limitations, such as poor seepage prevention effect, complex construction steps, and high construction costs. Due to influences of materials and construction, the adhesion between later reinforcement materials and the original structure is poor. In addition, the cost of fiber materials is higher.

SUMMARY

An objective of the present invention is to overcome the above shortcomings and provide an aqueduct leakage repairing method. A thin-wall formwork which is non-dismantling is used to pour a reinforcing layer inside an aqueduct body. The aqueduct leakage repairing method according to the present invention has simple construction steps for repairing aqueduct leakage and high construction efficiency.

The present invention is achieved by the following technical solution: an aqueduct leakage repairing method, in which a formwork is provided within an aqueduct body, a reinforcing layer is formed by using the formwork through pouring at inner sides of the aqueduct body; the formwork comprises side formwork plates, bottom formwork plates, and axillary angle formwork plates; the side formwork plates are arranged at inner vertical walls of the aqueduct body, the bottom formwork plates are arranged on a bottom of the aqueduct body, the bottom formwork plates are connected with the side formwork plates through the axillary angle formwork plates; and the axillary angle formwork plates are each provided with a plurality of ribs.

The aqueduct leakage repairing method comprises the following steps:

- S1: measuring a size of the aqueduct body to determine a size and a quantity of the formwork plates;
- S2: laying the formwork on the inner sides of the aqueduct body, clamping and fixing the bottom formwork plates, the axillary angle formwork plates and the side formwork plates with each other; providing fixing rods outside the formwork for fixation, providing supporting rods which are connected to the fixing rods for auxiliary fixation, and forming a gap between the inner sides of the aqueduct body and the formwork;
- S3: pouring concrete into the gap to form a reinforcing layer;
- S4: curing the reinforcing layer; and
- S5: removing the supporting rods and the fixing rods after curing, and the formwork which is a non-dismantling formwork forming a part of the aqueduct after pouring is completed.

The aqueduct leakage repairing method further comprises a step after step S5: cutting expansion joint at an original expansion joint position of the aqueduct, and then filling the expansion joint with fixed rubber parts.

A plurality of transverse and vertical stiffening ribs are arranged on side surfaces of the side formwork plates and the bottom formwork plates, and the stiffening ribs are rectangular ribs with rectangular sections; the fixing rods are arranged outside the side formwork plates and the bottom formwork plates for auxiliary fixation; the fixing rods are in a rod-shaped structure and are each provided with a plurality of clamps; each of the clamps includes an upper clamping head and a lower clamping head which are correspondingly arranged to form a clamping groove; the clamping grooves have rectangular sections which match with the rectangular ribs, so that the rectangular ribs are embedded into the clamping grooves for being clamped.

The side formwork plates and the bottom formwork plates have the same rectangular structure, each including upper and lower bottom surfaces and four side surfaces, convex strips and grooves are provided on the four side surfaces, and the convex strips are clamped with the grooves when the formwork plates are clamped with each other, so that the formwork has a tight structure.

The supporting rods are provided on outside surface of the fixing rods and support the fixing rods to strengthen fixation of the formwork.

The formwork has a thin-wall structure composed of fiber concrete. The formwork and the aqueduct are integrated after the fiber concrete are poured, and there is no need to remove the formwork.

In step S2, in the process of assembling the formwork, the convex strips and grooves on side surfaces of the side formwork plates and the bottom formwork plates are clamped with each other, the fixing rods clamp the rectangular ribs through the clamps to realize assembly and fixation of the formwork, and the formwork is supported through the fixing rods and the supporting rods. Axillary angle ribs are arranged on the axillary angle formwork plates to form high-strength axillary angle formwork plates.

In the aqueduct leakage repairing method of the present invention, overall performance of the formwork is improved through connection support of the high-strength axillary angle formwork plates, connection and fixation of the fixing rods and the supporting rods, and strengthened clamping of the convex strips and grooves on the side surfaces of the side formwork plates and the bottom formwork plates, so that supporting auxiliary components are reduced. The formwork is a thin-wall non-dismantling formwork; a lining layer is formed at inner walls of the aqueduct by using the thin-wall non-dismantling formwork, and then concrete is poured into a gap between the inner sides of the aqueduct body and the formwork, the poured concrete and the thin-wall non-dismantling formwork together form the reinforcing layer, which effectively reinforces penetration damage of the aqueduct, and the construction process is simple since the formwork is free from dismantling after construction.

Figure 1:
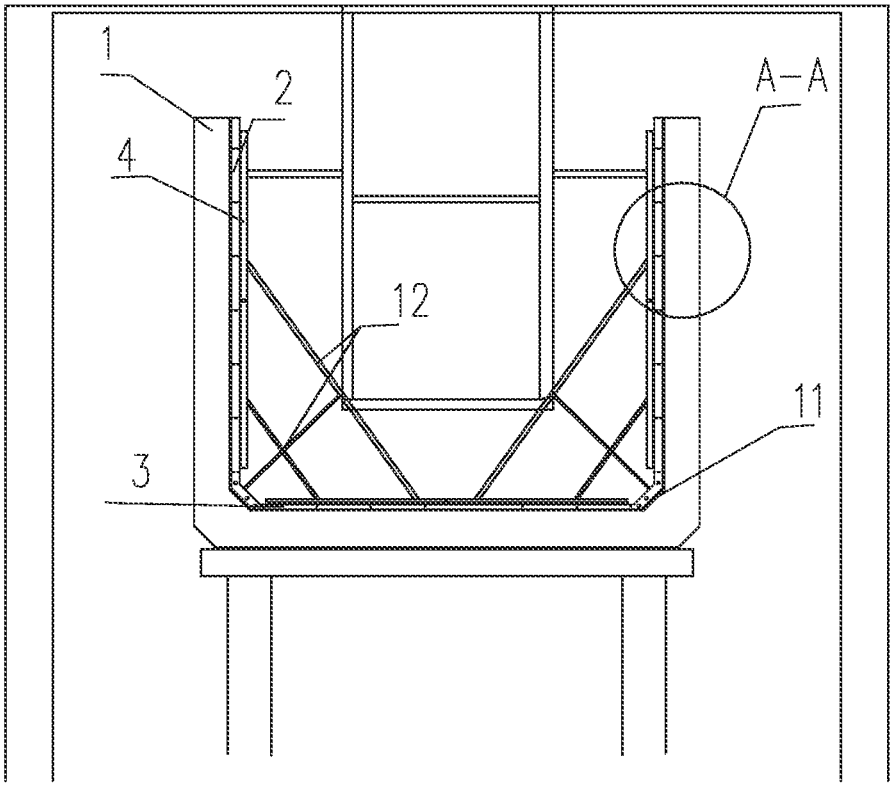
FIG. 1 is a schematic diagram according to the present invention.

Reference numerals: 1-aqueduct body, 2-side formwork plate, 3-bottom formwork plate, 4-fixing rod, 5-rectangular rib, 6-convex strip, 7-groove, 8-upper clamping head, 9-lower clamping head, 10-axillary angle rib, 11-axillary angle formwork plate, and 12-supporting rod.

DETAILED DESCRIPTION

The following description of the embodiments will be more helpful for the public to understand the present invention. However, the specific embodiments provided by the applicant cannot and should not be regarded as limitations on the technical solutions of the present invention. Any change in the definition of components or technical features and/or a formal but not substantial change to the overall structure should be regarded as falling into the protection scope defined by the technical solution of the present invention.

Figure 2:
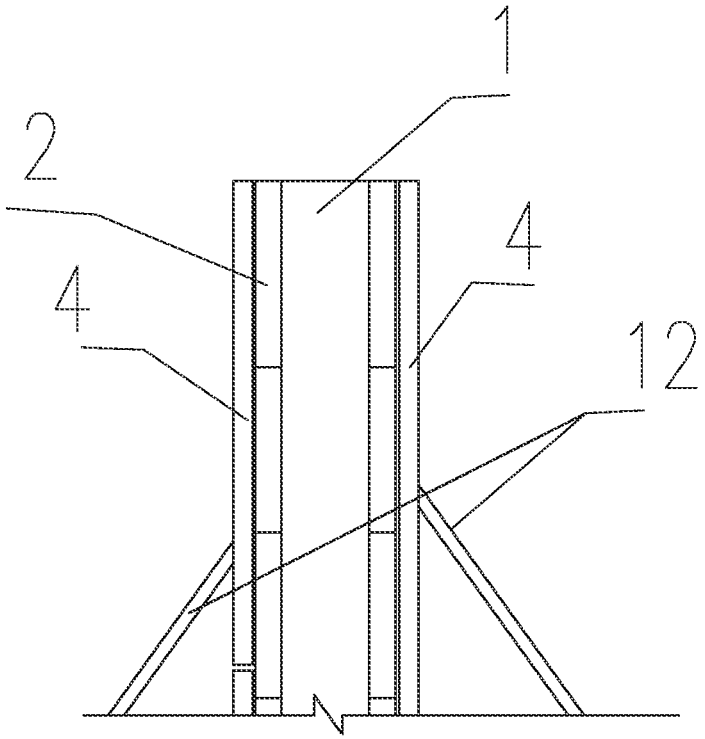
FIG. 2 is a schematic view of part A-A in FIG. 1 of the present invention.
Figure 3:
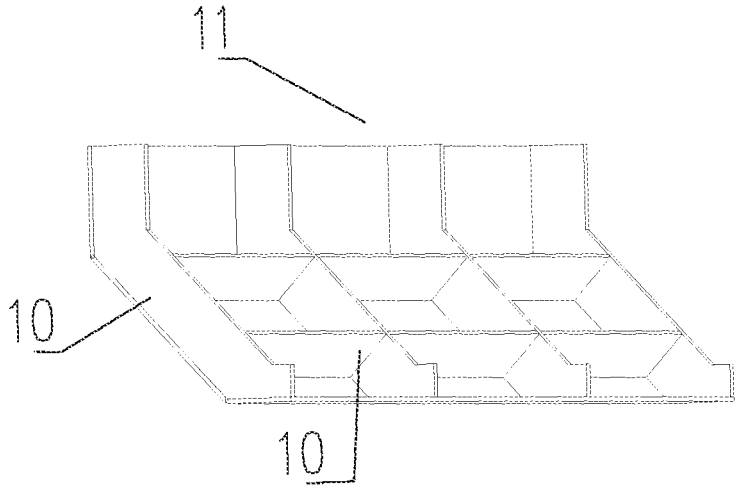
FIG. 3 is a schematic view of an axillary angle formwork plate of the present invention.
Figure 4:
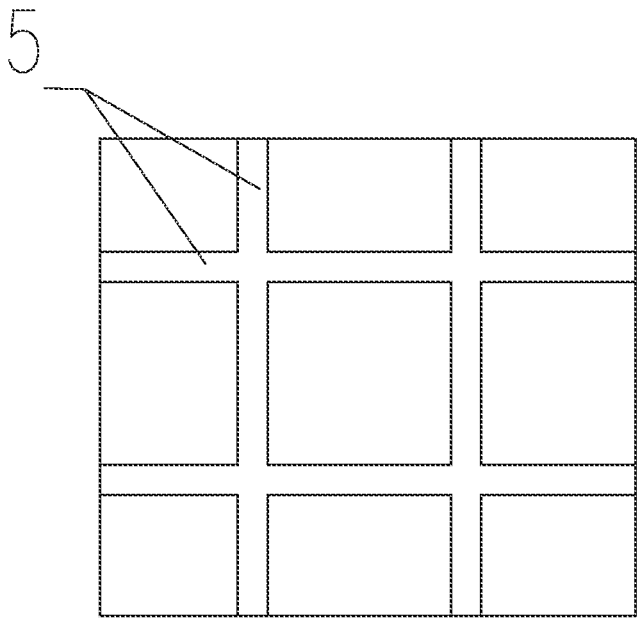
FIG. 4 is a front view of a side formwork plate of the present invention.
Figure 5:
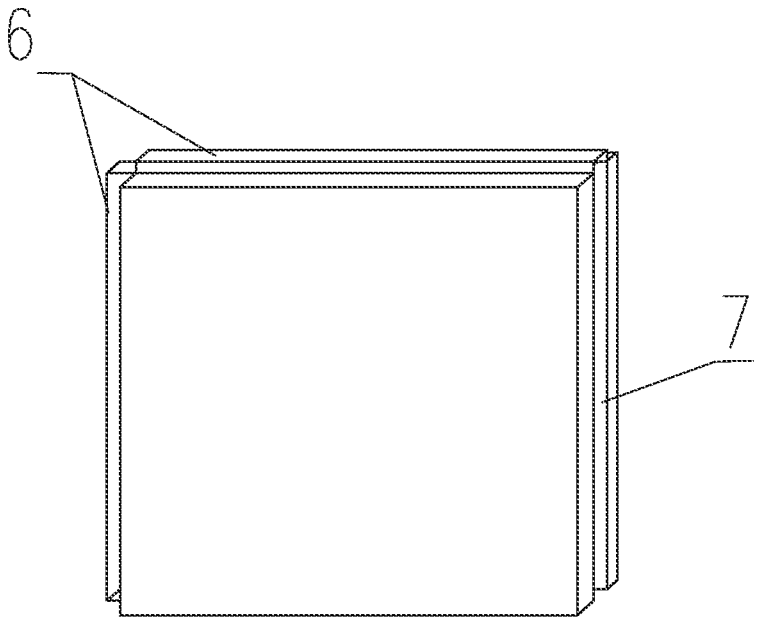
FIG. 5 is a schematic diagram of convex strips and grooves of a side formwork plate of the present invention.
Figure 6:
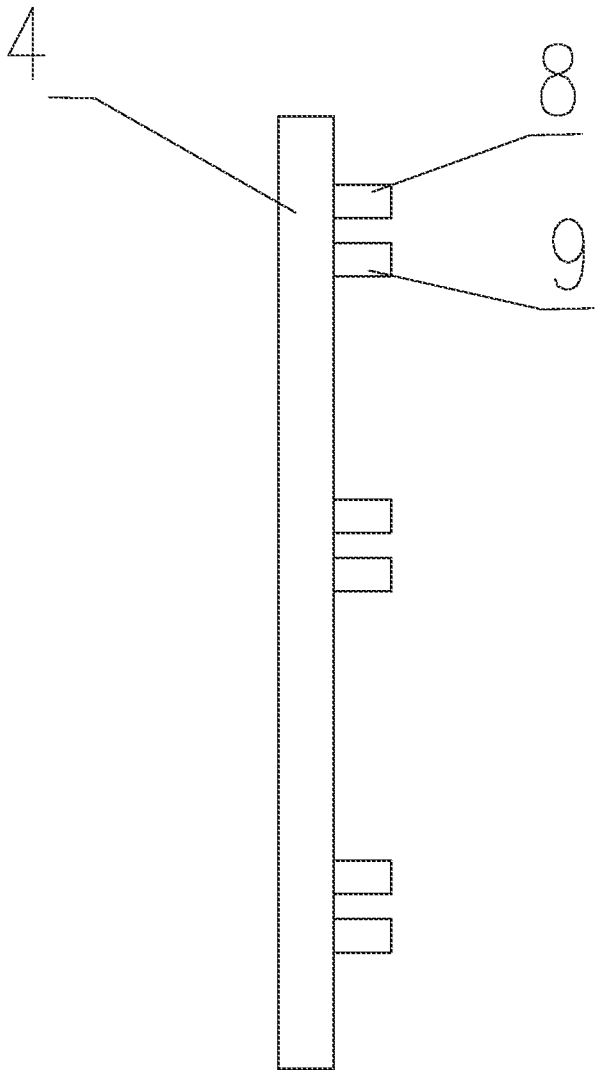
FIG. 6 is a schematic diagram of a fixing rod of the present invention.

Refer to FIGS. 1-6. The present invention is achieved by the following technical solution: an aqueduct leakage repairing method, in which a formwork is provided within an aqueduct body 1. The formwork comprises side formwork plates 2, bottom formwork plates 3, and axillary angle formwork plates 11. The side formwork plates 2 are arranged at inner vertical walls of the aqueduct body 1, the bottom formwork plates 3 are arranged on a bottom of the aqueduct body, and the bottom formwork plates 3 are connected with the side formwork plates 2 through the axillary angle formwork plates 11. The axillary angle formwork plates 11 are each provided with a plurality of stiffening plates to improve supporting strength of the axillary angle formwork plates 11.

A plurality of transverse and vertical stiffening ribs are arranged on side surfaces of the side formwork plates 2 and the bottom formwork plates 3, and the stiffening ribs are rectangular ribs 5 with rectangular sections. The fixing rods 4 are arranged outside the side formwork plates 2 and the bottom formwork plates 3 for auxiliary fixation. The fixing rods 4 are in a rod-shaped structure and are each provided with a plurality of clamps. Each of the clamps includes an upper clamping head 8 and a lower clamping head 9 which are correspondingly arranged to form a clamping groove. The clamping grooves have rectangular sections which match with the rectangular ribs 5, so that the rectangular ribs 5 are embedded into the clamping grooves for being clamped. In addition, the upper clamping head 8 and lower clamping head 9 are provided with lugs on side surfaces, middle portions of the lugs are correspondingly provided with bolt holes. The lugs are engaged with the rectangular ribs 5 and pass through the bolt holes via bolts to strengthen fixation of the fixing rods 4 to the rectangular ribs 5.

The side formwork plates 2 and the bottom formwork plates 3 have the same rectangular structure, each including upper and lower bottom surfaces and four side surfaces. Convex strips 6 and grooves 7 are provided on the four side surfaces, and the convex strips 6 are clamped with the grooves 7 when the formwork plates are clamped with each other, so that the formwork has a tight structure.

The supporting rods 12 are provided on outside surface of the fixing rods 4. The supporting rods 12 and the fixing rods 4 strengthen fixation of the formwork.

The formwork is composed of fiber concrete. The formwork and the aqueduct are integrated after the fiber concrete are poured, and there is no need to remove the formwork.

The aqueduct leakage repairing method comprises the following steps:

- S1: measuring a size of the aqueduct body 1 to determine a size and a quantity of the formwork plates;
- S2: laying the formwork on the inner sides of the aqueduct body, clamping and fixing the bottom formwork plates 3, the axillary angle formwork plates 11 and the side formwork plates 2 with each other; providing fixing rods 4 outside the formwork for fixation, providing supporting rods 12 which are connected to the fixing rods 4 for auxiliary fixation, and forming a gap between the inner sides of the aqueduct body and the formwork;
- S3: pouring concrete into the gap to form a reinforcing layer;
- S4: curing the reinforcing layer; and
- S5: removing the supporting rods 12 and the fixing rods 4 after curing, and the formwork which is a non-dismantling formwork forming a part of the aqueduct after the concrete is poured.

The aqueduct leakage repairing method further comprises a step S6 after step S5: cutting expansion joint at an original expansion joint position of the aqueduct, and then filling the expansion joint with fixed rubber parts.

In step S2, in the process of assembling the formwork, the convex strips 6 and grooves 7 on side surfaces of the side formwork plates 2 and the bottom formwork plates 3 are clamped with each other, the fixing rods 4 clamp the rectangular ribs 5 through the clamps to realize assembly and fixation of the formwork, and the formwork is supported through the fixing rods 4 and the supporting rods 12. Axillary angle ribs 10 are arranged on the axillary angle formwork plates 11 to form high-strength axillary angle formwork plates.

The formwork has a thin-wall structure composed of fiber concrete.

In the aqueduct leakage repairing method of the present invention, overall performance of the formwork is improved through connection support of the high-strength axillary angle formwork plates, connection and fixation of the fixing rods 4 and the supporting rods 12, and strengthened clamping of the convex strips 6 and grooves 7 on the side surfaces of the side formwork plates 2 and the bottom formwork plates 3, so that supporting auxiliary components are reduced. A lining layer is formed at inner walls of the aqueduct by using the thin-wall non-dismantling formwork, and then concrete is poured into a gap between the inner sides of the aqueduct body and the formwork, the poured concrete and the thin-wall non-dismantling formwork together form the reinforcing layer, which effectively reinforces penetration damage of the aqueduct, and the construction process is simple since the formwork is free from dismantling after construction.

The invention claimed is:

1. An aqueduct leakage repairing method, in which a formwork is provided within an aqueduct body, a reinforcing layer is formed by using the formwork through pouring concrete at inner sides of the aqueduct body; the formwork comprises side formwork plates, bottom formwork plates, and axillary angle formwork plates; the side formwork plates are arranged at inner vertical walls of the aqueduct body, the bottom formwork plates are arranged on a bottom of the aqueduct body, the bottom formwork plates are connected with the side formwork plates through the axillary angle formwork plates; and the axillary angle formwork plates are each provided with a plurality of ribs; wherein the aqueduct leakage repairing method comprises the following steps:

S1: measuring a size of the aqueduct body to determine a size and a quantity of the formwork plates;

S2: laying the formwork on the inner sides of the aqueduct body, clamping bottom formwork plates, the axillary angle formwork plates and the side formwork plates with adjacent formwork plates and fixing together; providing fixing rods outside the formwork for fixation, providing supporting rods which are connected to the fixing rods for auxiliary fixation, and forming a gap between the inner sides of the aqueduct body and the formwork;

S3: pouring the concrete into the gap to form the reinforcing layer;

S4: allowing the concrete of the reinforcing layer to cure; and

S5: removing the supporting rods and the fixing rods after the concrete has cured, and the formwork which is a non-dismantling formwork forming a part of the aqueduct after the pouring is completed;

a plurality of transverse and vertical stiffening ribs are arranged on side surfaces of the side formwork plates and the bottom formwork plates, and the stiffening ribs are rectangular ribs with rectangular sections; the fixing rods are arranged outside of the side formwork plates and the bottom formwork plates for auxiliary fixation; the fixing rods each have a rod-shaped structure and are each provided with a plurality of clamps; each of the clamps includes an upper clamping head and a lower clamping head which are correspondingly arranged to form a clamping groove; the clamping grooves have rectangular cross-sections which are same as cross-sections of the rectangular ribs, so that the rectangular ribs are clamped into the clamping grooves.

2. The aqueduct leakage repairing method of claim 1, wherein the side formwork plates and the bottom formwork plates have a same rectangular structure, each including an upper and a lower surfaces and four side surfaces between the upper and the lower bottom surfaces, convex strips and grooves are provided on the side surfaces, and convex strips of formwork plates are clamped with grooves of adjacent formwork plates when the formwork plates are assembled.

3. The aqueduct leakage repairing method of claim 1, wherein the formwork comprises a thin-wall structure composed of fiber concrete, and the formwork and the aqueduct are integrated after the pouring is completed.

4. The aqueduct leakage repairing method of claim 1, wherein the aqueduct leakage repairing method further comprises a step after step S5: cutting an expansion joint at an original expansion joint position of the aqueduct, and then filling and fixing rubber parts in the expansion joint.

5. The aqueduct leakage repairing method of claim 2, wherein the upper and lower clamping heads are each provided with lugs on side surfaces, middle portions of the lugs are correspondingly provided with bolt holes, the clamps are clamped with the rectangular ribs and bolts pass through the bolt holes so that clamping of the fixing rods with the rectangular ribs is strengthened.

6. The aqueduct leakage repairing method of claim 2, wherein the formwork comprises a thin-wall structure composed of fiber concrete, and the formwork and the aqueduct are integrated after the pouring is completed.

7. The aqueduct leakage repairing method of claim 2, wherein the aqueduct leakage repairing method further comprises a step after step S5: cutting an expansion joint at an original expansion joint position of the aqueduct, and then filling and fixing rubber parts in the expansion joint.

* * * * *